US005312666A

United States Patent [19]

Jovanovic

[11] Patent Number: 5,312,666

[45] Date of Patent: May 17, 1994

[54] DISINFECTABLE THREE PIECE WALL MOUNTED BACK SCRUBBER USING DETACHABLE CLOTH SURFACE

[76] Inventor: Karol Jovanovic, 24 River Rd., Clifton, N.J. 07015

[21] Appl. No.: 876,450

[22] Filed: Apr. 30, 1992

[51] Int. Cl.[5] ..... B32B 1/06; B32B 3/26

[52] U.S. Cl. ..... 428/76; 428/83; 428/99; 428/71; 4/606; 15/146

[58] Field of Search ..... 428/71, 68, 83, 99, 428/76; 15/110, 146, 244.1, 244.3, 244.4; 4/606

*Primary Examiner*—Alexander S. Thomas
*Attorney, Agent, or Firm*—Abdallah & Muckelroy

[57] ABSTRACT

A backwasher is provided and consists of three essential elements. A back element for retaining a resilient nonabsorbent pillow-like member in conjunction with a front engaging member which attaches to the rear member by means of frictionally engaging a cloth-like material extended over the surface of the resilient member whereby the resilient member covered by the cloth-like material when mounted vertically on a wall functions as a backwasher or backscrubber when a person moves their back over the protruding surface of the pillow-like member. The device is adapted so that a person may use a personal wash cloth for backscrubbing and then remove same for continued bathing and such that the device may be easily disinfected for use by different persons in a hotel environment.

2 Claims, 2 Drawing Sheets

DISINFECTABLE THREE PIECE WALL MOUNTED BACK SCRUBBER USING DETACHABLE CLOTH SURFACE

BACKGROUND OF THE INVENTION

The instant invention relates generally to bathing implements and more specifically relates to a backwasher.

Numerous bathing instruments have been provided in the prior art which are adapted to aid people when washing in the shower or bathtub such as for example brushes, scrubbers or the like. While these prior art units may be suitable for the particular purpose to which they address they are not as suitable for the purposes of the present invention as hereinafter described.

SUMMARY OF THE INVENTION

The primary object of the present invention is to provide a backwasher that will overcome the shortcomings of the prior art devices.

Another object is to provide a backwasher that can be affixed to a shower wall or bathtub wall so that a person can wash their back with a washcloth.

An additional object is to provide a backwasher that is structured to being resilient yet nonabsorbent and therefore disinfectable so that it can be easily adapted for use in a hotel, dormitory, school, or other institutional environment predominated by showers utilized by different persons.

A further object is to provide a backwasher that is simple to manufacture made essentially of three elements exclusive of the means for attachment and easy to use.

A still further object is to provide a backwasher that is economical in cost for use, easy to clean and requires only the addition of a personalized washcloth for insured sanitation.

A further object of the invention will appear in the following description of the preferred embodiment.

To accomplish the above and related objects, this invention is embodied in the form illustrated in the accompanying drawings, attention being called to the fact however that the drawings are illustrative only in that changes in shape configuration and means for attaching said invention to a wall may be made in the specific construction illustrated and described within the scope of the appended claims.

DESCRIPTION OF THE PREFERRED EMBODIMENT

Figure 1:
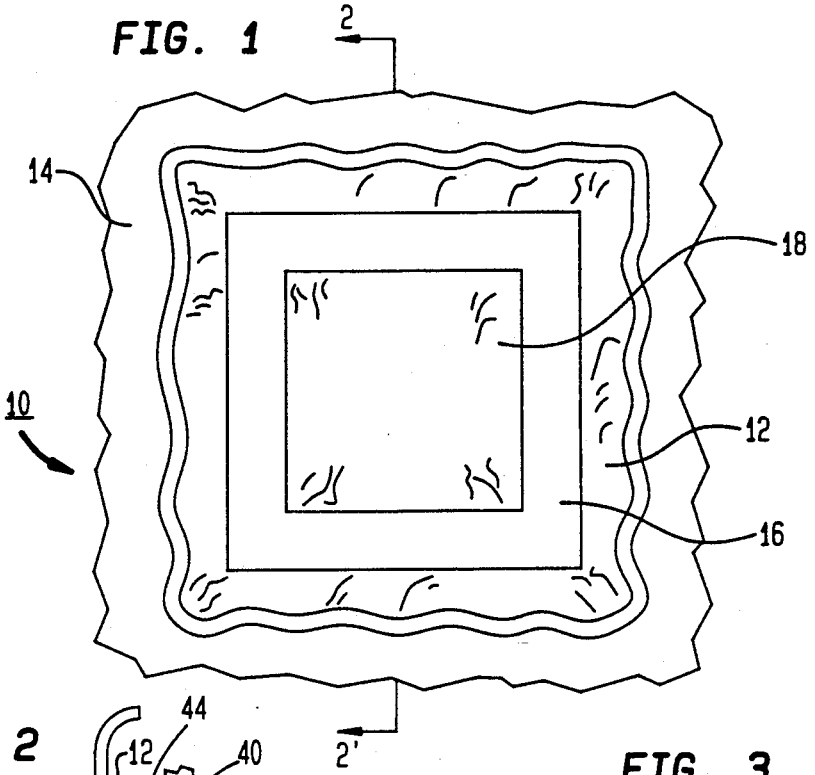
FIG. 1 is a front view of the novel invention.
Figure 2:
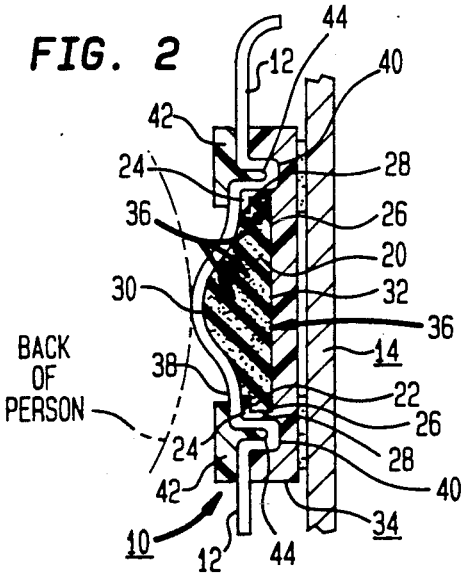
FIG. 2 is a cross section of the novel invention as shown in FIG. 1 taken the long plane 2—2'.

Referring now descriptively to the drawings, in which similar reference numerals denote similar elements throughout the several views, in particular, FIGS. 1 and 2 illustrate the entire invention with FIG. 2 being a cross section of a backwasher 10 shown generally in FIG. 1.

In FIG. 1 there is shown the backwasher 10 made up of a cloth-like piece 12 being retained against a wall 14 by a retaining member 16. A substantial portion 18 of the piece 12 extends above the retaining member 16 and away from the wall 14. Portion 18 performs the actual back scrubbing action for the backwasher 10. The piece 12 is mounted substantially vertically by means of the retaining member 16 against the wall 14 which is oriented vertically.

Referring now to FIG. 2 there is shown a cross section of the backwasher 10 of FIG. 1, the cross section being taken along the plane 2—2'. Shown in FIG. 2 is the backwasher 10 comprising a substantially pillow shaped resilient member 20. The resilient member 20 is made of a hard rubber for example. The member 20 is glazed or painted with an acrylic to insure its nonabsorbency and that its surface is capable of repelling water. The member 20 has an engaging lip 22. The lip 22 has a top and a bottom 26 separated by an edge 28. The engaging lip 22 extends circumferentially around the member 20. The member 20 has a mound-like front 30 and a flat back 32. The flat back 32 is coextensive with the bottom 26 of the engaging lip 22. The resilient member 20 is mounted vertically on the wall 14 by means of a frame 34 enclosing a cavity 36. The cavity 36 is framed by a retaining lip 38.

The cavity 36 is adapted to receive and retain the resilient member 20 by means of the surrounding retaining lip 24. The cavity 36 as adapted with the lip 24 securely and removably holds the resilient member in place. The resilient member 20 is removed simply by squeezing about the mound-like front and is thereby disengaged from the surrounding retaining lip 24. The frame 34 is adapted with at least one channel 40 near the outer periphery of the resilient member 20. The channel 40 is adapted to receive a retaining member 42. The retaining member 42 is adapted to removably retain a cloth-like piece 12 adjacent the mound-like front 30 of the resilient member 20. The cloth 12 is retained by the retaining member 42 over the mound-like front 30 of the resilient member. Thus, a back of a person may be rubbed or brushed against the protruding portion of the resilient member as covered by the cloth-like piece 12. Thereby, a backwashing or backscrubbing device such as the backwasher 10 is made useful and functional. The retaining member 42 further comprises or is made of a protuberant member 44. The channel 40 is adapted to receive the protuberant member 44 and as shown in FIG. 2 to frictionally hold the cloth-like piece 12 in between the channel 40 and the protuberant member 44.

The mound-like front 30 of the resilient member 20 as well as the back 32 is painted, covered, or otherwise made of a material such as for example close celled hard rubber whereby the resilient member 20 is easily and readily disinfectable and reusable much in the same manner as a disinfected toilet seat.

Figure 3:
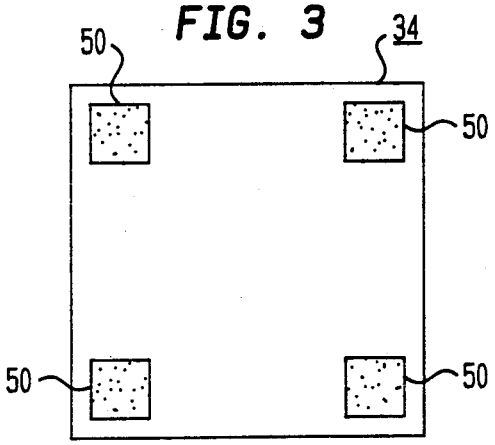
FIG. 3 is a rear view thereof.
Figure 4:
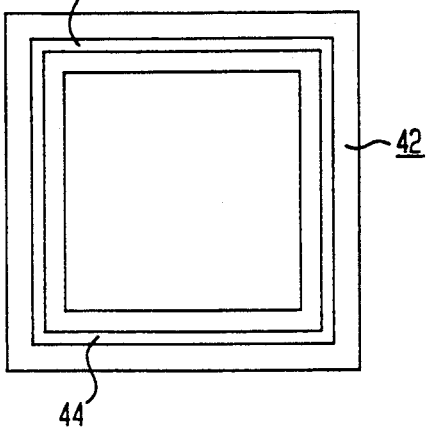
FIG. 4 is a rear plan view of the front retaining member portion of the invention.

In FIG. 3 there is shown the retaining member 42. Shown as a top member of the retaining member 42 namely a top plan view with the protuberant member 44 being shown.

In FIG. 3 there is shown a back view of the attaching member 34. There is shown adhesive rectangular members 50 disposed in four locations to facilitate attachment of the member 34 to the vertical wall 14 shown in FIGS. 1 and 2.

Figure 5:
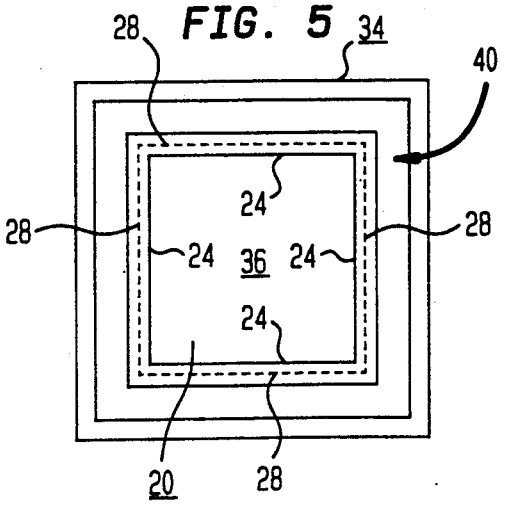
FIG. 5 is a top plan view of the bottom retaining member of the invention which attaches to a wall.

FIG. 5 is a top plan view of the retaining member 34 showing the cavity 36 surrounded by a channel 40. The edge 28 of the resilient member 20 is shown being retained by surrounding retaining lip 24.

Figure 6:
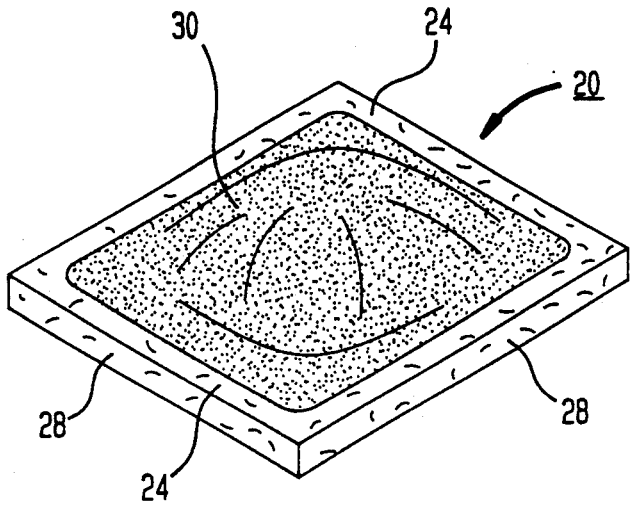
FIG. 6 is a perspective view of the resilient member portion of the backwasher.
Figure 7:
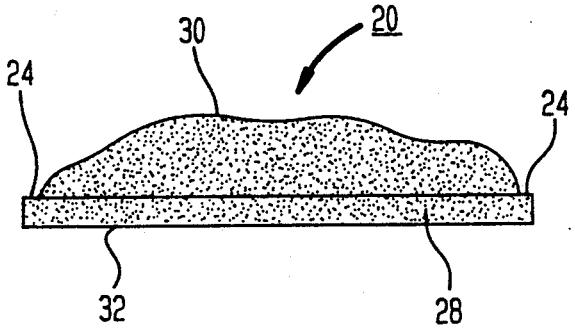
FIG. 7 is a side view of the resilient member shown in FIG. 6.

A perspective view of the resilient member 20 is shown in FIG. 6. A side view of the resilient member 20 is shown in FIG. 7.

While certain novel features of this invention have been shown and described and pointed out in the annexed claims, it will be understood that various submissions, substitutions and changes in the forms and details of the device illustrated and in its operations can be made by those skilled in the art of making equivalents without departing from the spirit of this invention. Therefore, insofar as the construction of the appended claims as construed it should be construed in conformity with the doctrine of equivalents.

What is claimed is:

1. A backwasher comprising a resilient member, a facecloth, a framed cavity securely and removably holding said resilient member in said cavity, said frame cavity having means for attaching said frame cavity securely and permanently to a wall, said framed cavity comprising a securing means securing said resilient member, said facecloth having an exposed surface and an opposite surface adjacent said resilient member, said resilient member having a first side resembling a mound and a second flat side, said facecloth being adjacent said first side, said securing means comprising a channel frictionally holding a protuberant member with a portion of said facecloth therein between, said resilient member, said framed cavity, and said securing means each being made of a non-absorbent material.

2. A backwasher comprising a substantially pillow-shaped resilient nonabsorbent member having a glazed, water repelling surface, said resilient member further having an engaging lip having a top and a bottom separated by an edge, said lip extending circumferentially around said resilient member, said resilient member having a mound-like front and a substantially flat back coextensive with the bottom of said resilient member, a cavity framed with a retaining lip, said cavity securely and removably holding said resilient member, said retaining lip extending about the top of said engaging lip, retaining said resilient member inside said cavity, a retaining member removably retaining a cloth-like piece adjacent the front of said resilient member, said retaining member at least partially enclosing an area of said piece over said mound-like front, said retaining member comprising a protuberant member, said cavity being at least partially surrounded by a channel receiving said protuberant member and frictionally holding said piece in between said channel and said protuberant member, said resilient member being made of a disinfectable rubber-like material.

* * * * *